US012629602B2

(12) United States Patent
Li

(10) Patent No.: US 12,629,602 B2
(45) Date of Patent: May 19, 2026

(54) TOY

(71) Applicant: Shenzhen Beipengxing Technology Co., Ltd, Shenzhen (CN)

(72) Inventor: Lifang Li, Shenzhen (CN)

( * ) Notice: Subject to any disclaimer, the term of this patent is extended or adjusted under 35 U.S.C. 154(b) by 202 days.

(21) Appl. No.: 18/524,042

(22) Filed: Nov. 30, 2023

(65) Prior Publication Data

US 2024/0173637 A1 May 30, 2024

(30) Foreign Application Priority Data

Nov. 30, 2022 (CN) ..... 202223184360.0

(51) Int. Cl.
*A63H 13/16* (2006.01)
*A63H 33/00* (2006.01)

(52) U.S. Cl.
CPC ..... *A63H 13/16* (2013.01); *A63H 33/003* (2013.01)

(58) Field of Classification Search
CPC ..... A63H 13/00; A63H 13/16; A63H 33/003
See application file for complete search history.

(56) References Cited

U.S. PATENT DOCUMENTS 1,615,925 A * 2/1927 Yancey ..... A63F 9/0413 D21/589
2,767,516 A * 10/1956 Del Mas ..... A63H 3/48 446/376
2,968,121 A * 1/1961 Pearson, Jr. ..... A63H 37/00 403/166
3,586,320 A * 6/1971 Mace ..... A63H 37/00 116/303
5,019,010 A * 5/1991 Nikaido ..... A63H 33/003 446/376
7,950,979 B2 * 5/2011 Barthold ..... A63H 17/26 446/470
8,517,791 B2 * 8/2013 Yamada ..... A63H 33/26 446/129
11,376,515 B1 * 7/2022 Livingston ..... A63H 3/365
2016/0361661 A1 * 12/2016 Tiefel ..... A63H 3/003

FOREIGN PATENT DOCUMENTS

KR 20090071347 A * 7/2009 ..... A44C 25/001
WO WO-2006006673 A1 * 1/2006 ..... A63H 13/16

OTHER PUBLICATIONS

Translation WO2006006673A1 (Year: 2006).*
Translation KR20090071347A (Year: 2009).*

* cited by examiner

*Primary Examiner* — Eugene L Kim
*Assistant Examiner* — Alyssa M Hylinski
(74) *Attorney, Agent, or Firm* — Daniel M. Cohn; Howard M. Cohn

(57) ABSTRACT

The present disclosure provides a toy, comprising: a shell, a movable seat and a swing rod; the movable seat comprises the first part and the second part, the first part is connected to the second part, the first part is slidably disposed inside the shell, the second part protrudes from the shell, the side wall of the first part is provided with a window; the window is configured to be exposed from the shell as the first part slides out of the shell, and is configured to be hidden in the shell as the first part slides back into the shell; the swing rod is rotatably disposed inside the movable seat and is configured to rotate when the window is exposed and at least part of the swing rod swings out from the window.

11 Claims, 14 Drawing Sheets

TOY

TECHNICAL FIELD

The present disclosure relates to a technical field of toy, and in particular to a toy a toy with funny and interesting.

BACKGROUND

In daily life, in order to relieve stress, you can use toys to add fun to life. Funny toys can enhance the fun and enhance the emotions between people while giving appropriate scares. Most of the existing funny toys have a box-type structure. After pressing the switch on the box, the lid of the box opens, and the funny characters pop up inside to give people a proper scare. This type of toys has been on the market for a long time, and the fun it can bring to people has also declined. The box style is large, the structure is bloated, it is difficult to operate and play, and the fun is low.

SUMMARY

In order to solve the problem of limited usage scenarios of existing toy, the present disclosure provides a toy. A toy, comprising: a shell, a movable seat and a swing rod. The movable seat comprises the first part and the second part, the first part is connected to the second part, the first part is slidably disposed inside the shell, the second part protrudes from the shell, the side wall of the first part is provided with a window; the window is configured to be exposed from the shell as the first part slides out of the shell, and is configured to be hidden in the shell as the first part slides back into the shell. The swing rod is rotatably disposed inside the movable seat and is configured to rotate when the window is exposed and at least part of the swing rod swings out from the window.

BRIEF DESCRIPTION OF DRAWINGS

In order to more clearly illustrate technical solutions in embodiments of the present disclosure, drawings required in description or prior art are briefly introduced below, and obviously, the drawings in the following description are merely some embodiments of the present disclosure. For a person having ordinary skill in art, other drawings may be obtained according to the drawings without creative efforts.

REFERENCE NUMBER IN THE DRAWINGS

Figure 1:
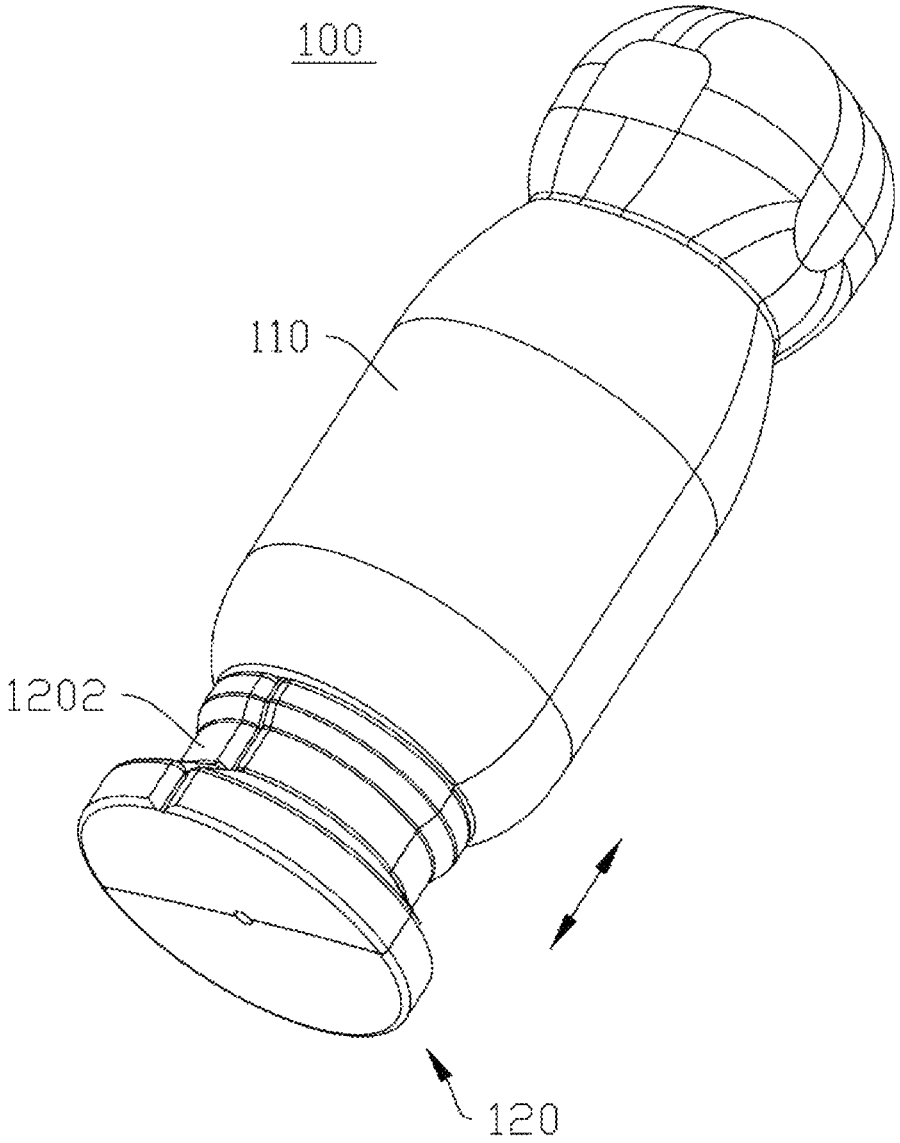
FIG. 1 is a schematic structural diagram of a toy in a default state of the toy.

| | | | |
|---|---|---|---|
| toy | 100 | shell | 110 |
| upper shell | 111 | lower shell | 112 |
| shell head | 113 | shell tail | 114 |
| accommodation cavity | 115 | opening | 116 |
| connecting column | 117 | abutting portion | 118 |
| first strip protrusion | 1181 | second strip protrusion | 1182 |
| second guide plane | 119 | movable seat | 120 |
| first part | 1201 | second part | 1202 |
| window | 121 | strip groove | 122 |
| connecting port | 1221 | connecting ring | 123 |
| first limiting part | 124 | second limiting part | 125 |
| movable seat head | 126 | first guide chute | 1261 |
| second guide chute | 1262 | first guide plane | 1263 |
| movable seat tail | 127 | movable seat base | 128 |
| swing rod | 130 | first end of the swing rod | 1301 |
| second end of the swing rod | 1302 | rotating shaft | 131 |
| connecting part | 132 | first elastic member | 140 |
| first end of the first elastic member | 141 | second end of the first elastic member | 142 |
| second elastic member | 150 | switch | 161 |
| first buzzer | 162 | first lamp body | 163 |
| second buzzer | 164 | second lamp body | 165 |
| third buzzer | 166 | third lamp body | 167 |
| battery | 168 | control circuit board | 169 |

DETAILED DESCRIPTION

The following describes in detail the embodiments of the present disclosure, examples of which are illustrated in the accompanying drawings, wherein the same or similar reference numerals refer to the same or similar elements or elements having the same or similar functions throughout. The embodiments described below with reference to the accompanying drawings are exemplary, and are not intended to limit the present disclosure.

In the description of the present disclosure, it should be understood that orientation or positional relationship indicated by terms "length", "width", "upper", "lower", "front", "rear", "left", "right", "vertical", "horizontal", "top", "bottom", "inner", "outer" and so on are based on the orientation or positional relationship shown in the drawings, rather than indicating or implying that an indicated device or an indicated element must have a particular orientation, are constructed and operated in a particular orientation, and are therefore not to be construed as limiting the present disclosure.

In addition, terms such as "first" and "second" are only used for the purpose of description, rather than being understood to indicate or imply relative importance or hint the number of indicated technical features. Thus, the feature limited by "first" and "second" can explicitly or impliedly include at least one feature. In the description of the present disclosure, the meaning of "a plurality of" is at least two, unless otherwise specified. Also, as used herein, "and/or" refers to and encompasses any and all possible combinations of one or more of the associated listed items.

In the present disclosure, the terms such as "mounting", "connected", "connected to", "fixed at", and the others should be understood in a broad sense unless expressly stated or limited otherwise; for example, it may be a fixed connection or a detachable connection, or integrated; it can be a mechanical connection or an electrical connection; it can be a direct connection or an indirect connection through an intermediate medium, and it can be the internal connection of the two elements or the interaction relationship between the two elements. For a person having ordinary skill in art, the specific meanings of the above terms in the present invention can be understood according to specific situations.

In daily life, in order to relieve stress, you can use toys to add fun to life. Funny toys can enhance the fun and enhance the emotions between people while giving appropriate scares. Most of the existing funny toys have a box-type structure. After pressing the switch on the box, the lid of the box opens, and the funny characters pop up inside to give people a proper scare. This type of toys has been on the market for a long time, and the fun it can bring to people has also declined. The box style is large, the structure is bloated, it is difficult to operate and play, and the fun is low.

In order to solve the problem of limited usage scenarios of existing toy, the present disclosure provides a toy. The toy has a movable seat sliding inside the shell, and a swing rod rotating inside the movable seat. When in use, grab the shell with one hand and pull the movable seat with the other hand to extend it. At the same time, the swing rod will move from the movable seat. The window on the seat pops up, giving people a proper scare, making it more funny and interesting, and at the same time, it is very easy to operate.

In order to make the purpose, technical solutions, and advantages of the present disclosure clear, the following further describes the present disclosure in detail with reference to accompanying drawings and embodiments.

Figure 2:
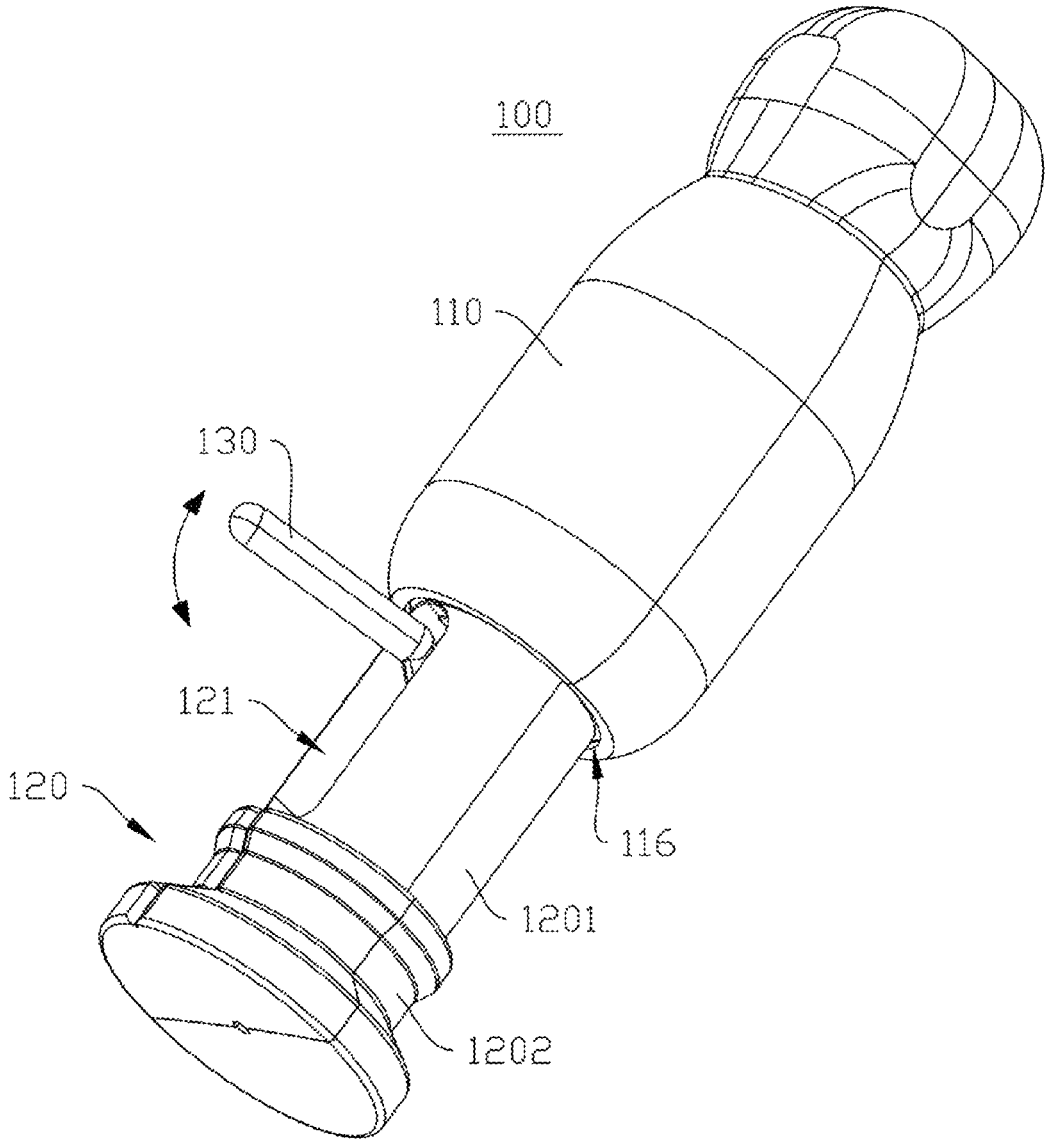
FIG. 2 is a schematic structural diagram of the toy shown in FIG. 1 in use.

Referring to FIG. 1 and FIG. 2, FIG. 1 shows the structure of the toy provided by the embodiment of the present disclosure in its default state, and FIG. 2 shows the state of the toy in use. The toy 100, comprising: a shell 110, a movable seat 120 and a swing rod 130; the movable seat 120 comprises the first part 1201 and the second part 1202, the first part 1201 is connected to the second part 1202, the first part 1201 is slidably disposed inside the shell 110, the second part 1202 protrudes from the shell 110, the side wall of the first part 1201 is provided with a window 121; the window 121 is configured to be exposed from the shell 110 as the first part 1201 slides out of the shell 110, and is configured to be hidden in the shell 110 as the first part 1201 slides back into the shell 110; the swing rod 130 is rotatably disposed inside the movable seat 120 and is configured to rotate when the window 121 is exposed and at least part of the swing rod 130 swings out from the window 121.

Figure 3:
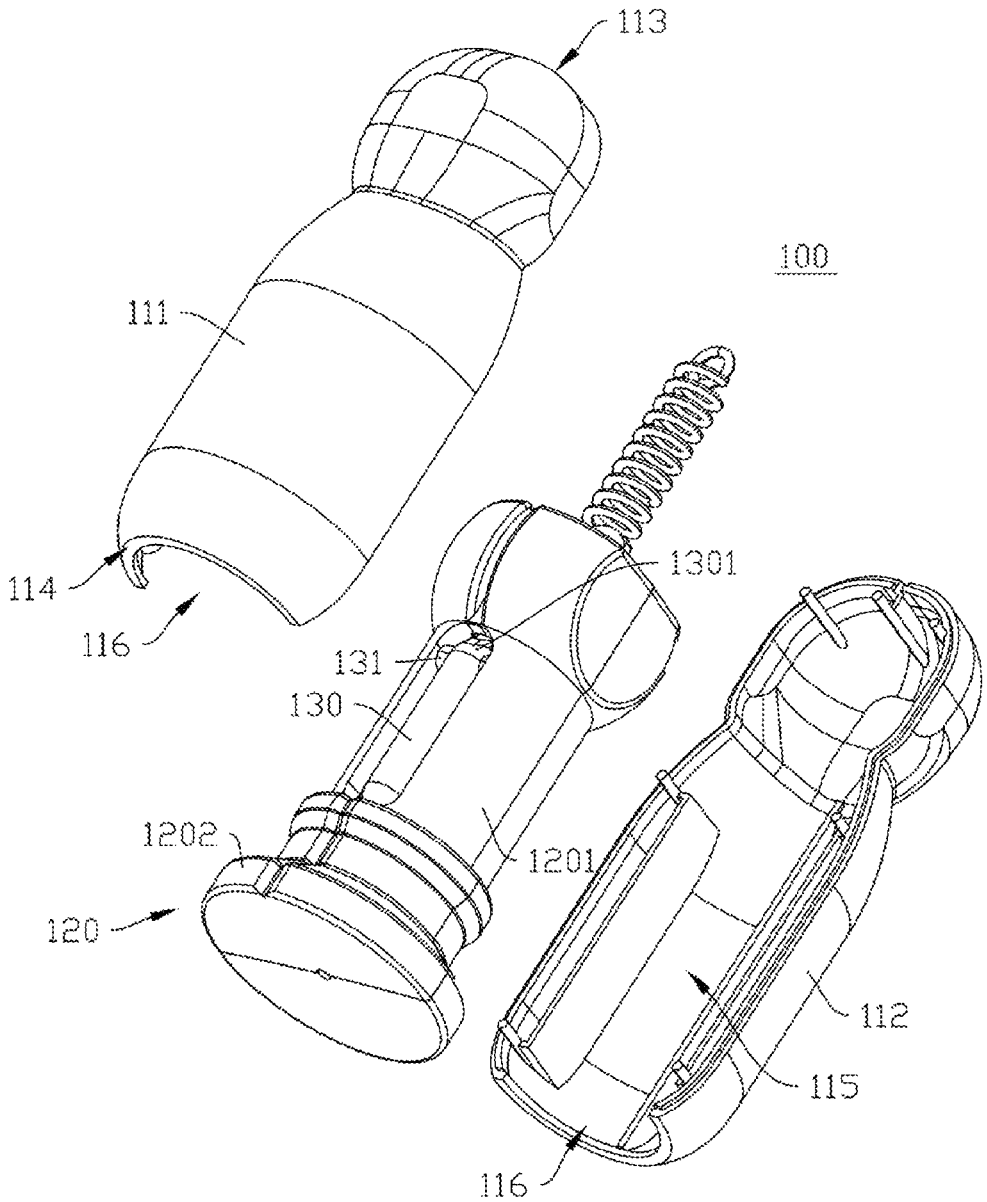
FIG. 3 is a schematic structural diagram of the shell and movable base of the toy shown in FIG. 1 after explosion.

The shell 110 can be designed as a Santa Claus, a doll, a robot, etc. The shell 110 is generally made of plastic material, which is convenient for processing and molding, and can make the toy 100 more portable. Considering the assembly of the toy 100, as shown in FIG. 3, which shows an exploded view of the toy, the shell 110 can include an upper shell 111 and a lower shell 112. The upper shell 111 and the lower shell 112 can be fastened and installed using snap-on posts, threaded connections, or other methods.

The shape of the movable seat 120 can be designed according to the shape of the shell 110. For example, when the shell 110 is provided for a character model, the movable seat 120 can be designed as a leg structure to present the character model with retractable legs. When the shell 110 adopts the shape of fruits, weapons, etc., the movable base 120 can be adaptively designed into the shape of fruit handles, fruit leaves, or weapon handles to enhance the overall fun of the toy 100.

Furthermore, in the embodiment shown in FIG. 2, the movable seat 120 adopts a columnar structure with a larger diameter, which can improve the structural strength and stability of the movable seat 120 and avoid risks such as breakage of the movable seat 120 during the sliding process. Similarly, the movable seat 120 can also be made of plastic material with a smooth surface, so as to reduce the weight of the toy 100 and at the same time allow the movable seat 120 to flexibly slide and expand relative to the shell 110.

The swing rod 130 can be set into a simple rod-shaped structure as shown in FIG. 2, and of course can also be set into a funny and interesting shape. For example, a tail with plush leather, arms wearing boxing gloves, etc. Since the swing rod 130 is small in size, its specific material has little impact on the overall weight of the toy 100, the swing rod 130 can be made of plastic, metal or other materials as needed, which is not limited here.

The sliding connection between the shell 110 and the movable seat 120 can be achieved by matching the chute and the slide block, the slide rail and the pulley, or simple surface friction contact. The rotational connection between the swing rod 130 and the movable seat 120 can be realized by shaft hole matching, hinge connection, etc. The way the swing rod 130 swings out automatically when the window 121 is exposed can be realized by using a torsion spring (not shown). Specifically, when the movable seat 120 is retracted into the window 121, the torsion spring is compressed to provide the swing rod 130 with an outward swinging torque. Therefore, when the window 121 is exposed, the swing rod 130 automatically swings out from the window 121 under the action of the torque provided by the torsion spring, thereby realizing the wackiness of the toy 100.

In this embodiment, the first part 1201 of the movable seat 120 is retractably and slidably connected to the shell 110, and the second part 1202 is protruded from the shell 110 so that the user can pull the first part 1201 out of the shell 110 through the second part 1202 to facilitate the sliding operation of the movable seat 120. At the same time, utilizing the telescopic connection between the movable seat 120 and the shell 110, when the first part 1201 is retracted into the shell 110, the window 121 on the first part 1201 and the swing rod 130 in the window 121 are covered and hidden by the shell 110. When the first part 1201 is pulled out from the shell 110, the window 121 is exposed, and the swing rod 130 automatically swings out from the window 121, giving people a proper scare, thereby providing good fun and humor on the premise of easy operation.

Figure 4:
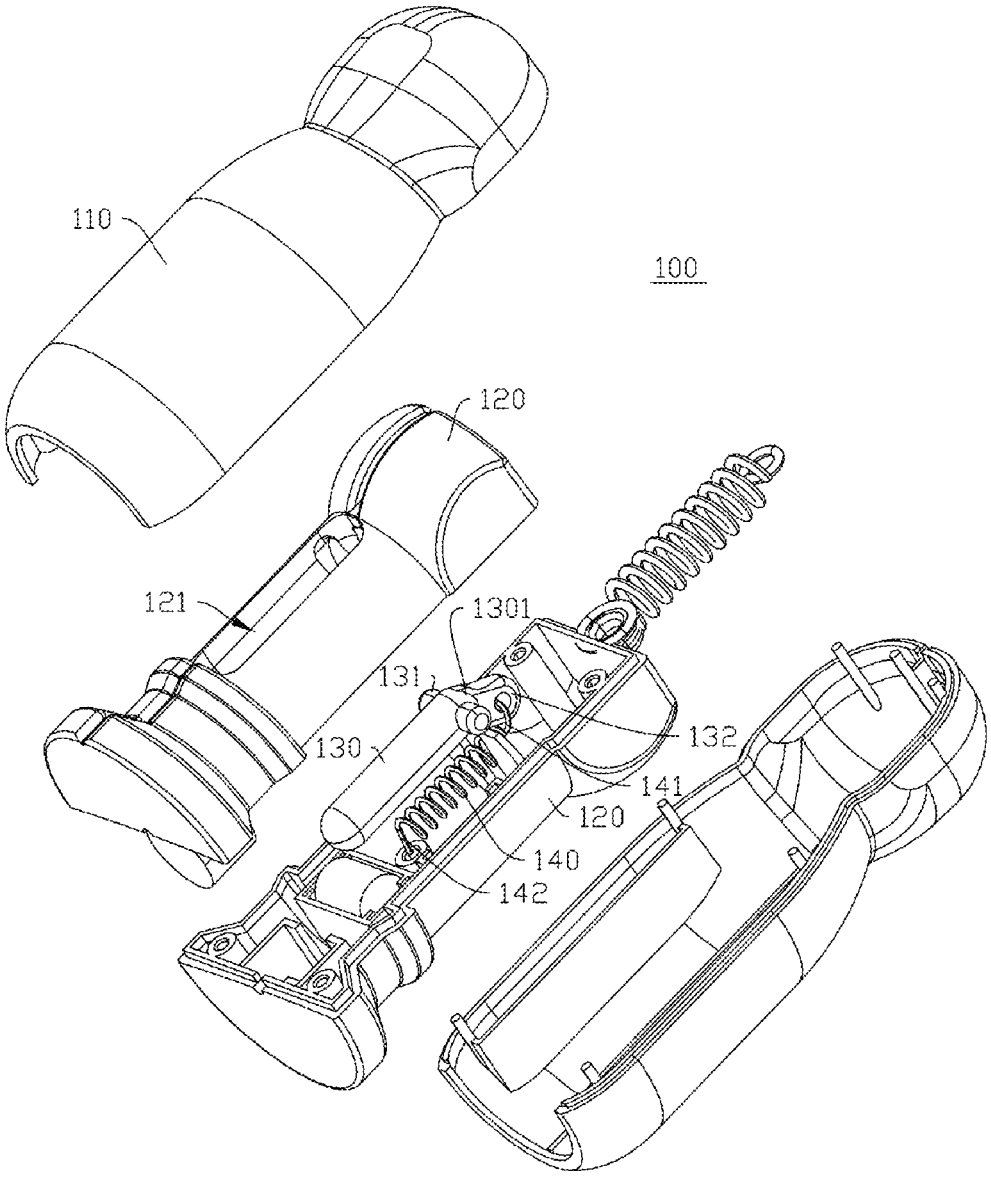
FIG. 4 is a schematic structural diagram of the toy movable seat shown in FIG. 3 after further explosion.

In addition to the automatic swing-out of the swing rod 130 through the torsion spring mentioned above, the present disclosure also proposes the embodiment. Referring to FIG. 4, it shows the explosive structure of the movable seat 120. As shown in the figure, a first elastic member 140 is connected between the first end of the swing rod 1301 the inner wall of the movable seat 120, the first elastic member 140 is configured to provide an elastic force to the swing rod 130 swinging out from the window 121 when the swing rod 130 is retracted into the window 121, so that when the window is exposed from the shell 110, the swing rod 130 is driven to swing out from the window 121.

Figure 5:
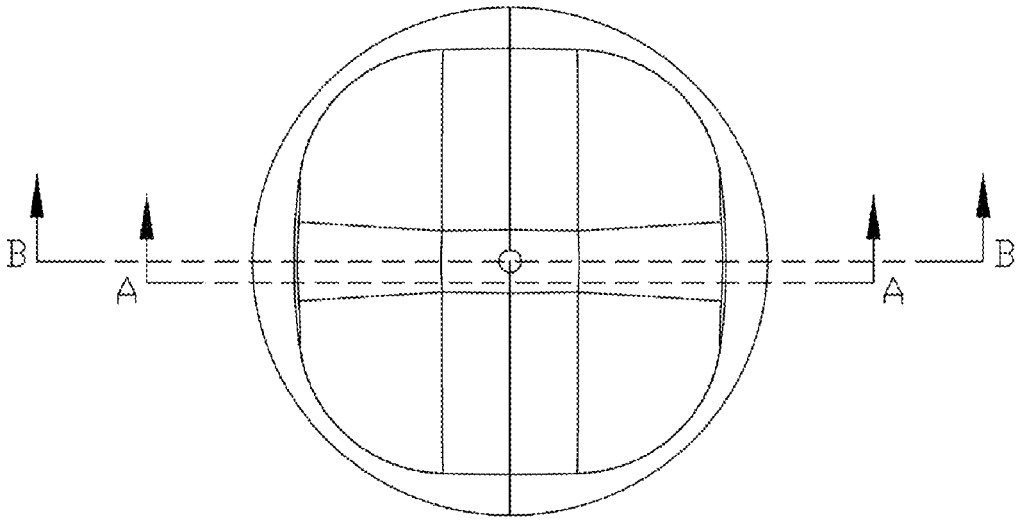
FIG. 5 is a schematic top view of the structure of the toy shown in FIG. 1.
Figure 6:
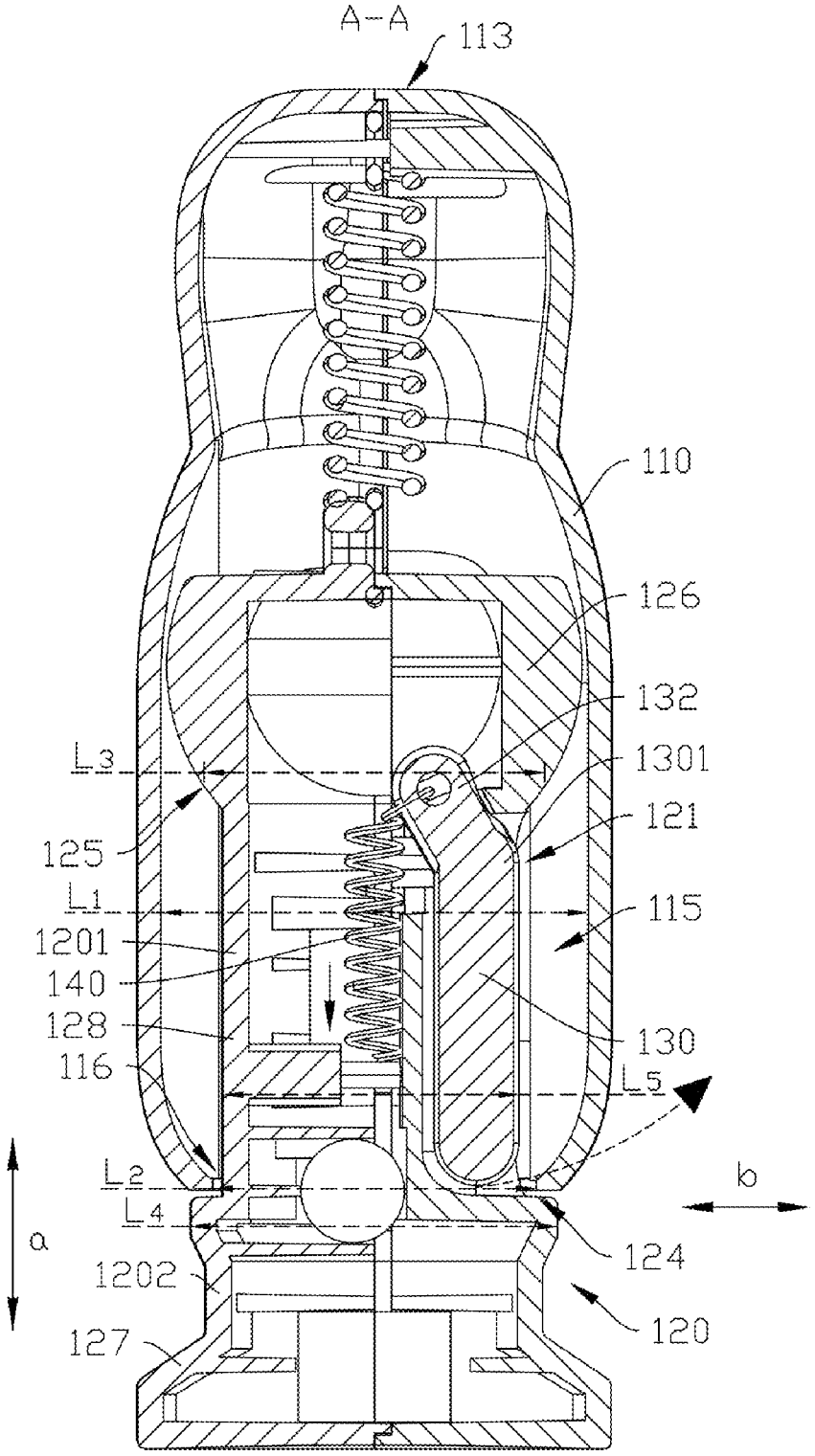
FIG. 6 is a schematic cross-sectional structural diagram along the A-A direction of FIG. 5.

Specifically, referring to FIG. 4 to FIG. 6, the first elastic member 140 is a spring. When the swing rod 130 is in the retracted state as shown in the figure, the spring is stretched and it provides a pulling force in the direction shown by the arrow at the spring in FIG. 6 to the end connected to the swing rod 130, so that when the window 121 is exposed from the shell 110, by pulling the first end of the swing rod 1301, the swing rod 130 is rotated in the direction indicated by the dotted arrow in FIG. 6 and swings out from the window 121.

It can be understood that FIG. 4 and FIG. 6 are only exemplary illustrations of the embodiments of the present disclosure. In another embodiment, by changing the positional relationship between the first elastic member 140 and the swing rod 130 and the deformation of the first elastic member 140 when the swing rod 130 is in the retracted state, the swing rod 130 can be automatically ejected in a variety of ways. The following is a brief description based on the two embodiments provided in FIG. 7*a* and FIG. 7*b:*

Figure 7:
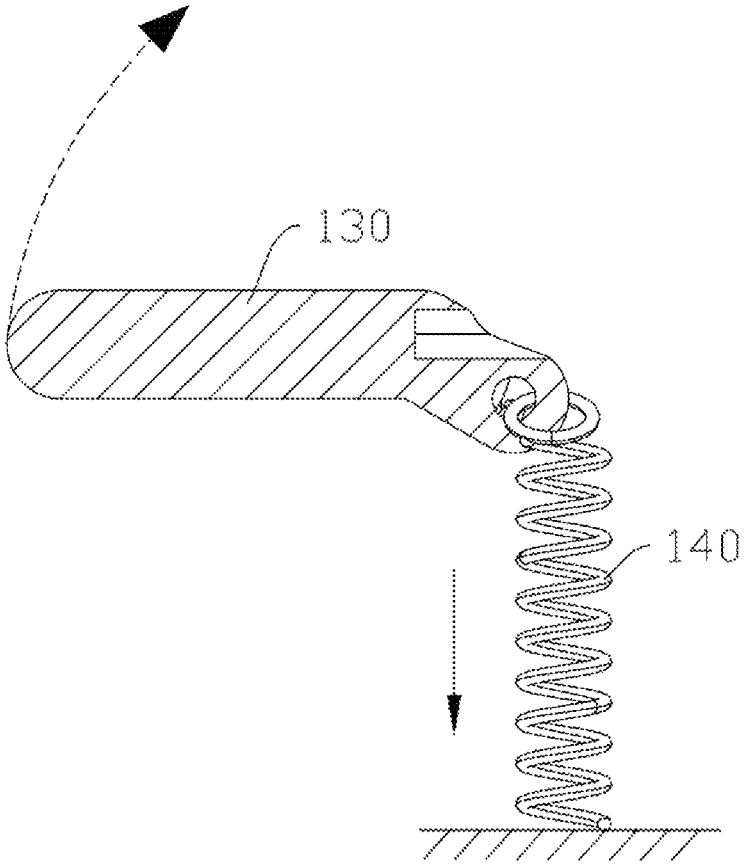
FIG. 7 is a schematic structural diagram of a modified first elastic member and swing rod in the toy.

As shown in FIG. 7*a*, the first elastic member 140 also uses a spring, and when the swing rod 130 is in the retracted state shown in FIG. 7*a*, the spring is still elongated to provide downward pulling force, thereby driving the window when the window is exposed. The swing rod 130 rotates and swings out in the direction shown by the dotted arrow in the figure.

As shown in FIG. 7*b*, the first elastic member 140 also uses a spring, but when the swing rod 130 is in the retracted state shown in FIG. 7*b*, the spring is compressed, providing a downward thrust as shown in FIG. 7*b*. When the window is exposed, one end of the swing rod 130 can be pushed to drive the swing rod 130 to rotate and swing out in the direction shown by the dotted arrow.

For the above embodiments, in addition to using springs, the first elastic member 140 may also be elastic members such as elastic pieces, rubber bands, etc., which are not limited here.

In order to optimize the layout of the pendulum drive components and make the internal structure of the movable seat more compact and smaller. The present disclosure further proposes the embodiment, please refer to FIG. 3 to FIG. 6 for details, as shown in the figure, the side wall of the first end of the swing rod 1301 is provided with a rotating shaft 131, and the rotating shaft 131 is rotationally connected to the inner wall of the movable seat 120; the end of the first end of the swing rod 1301 extends obliquely to form a connecting part 132; the first elastic member 140 is strip-shaped, and the extending direction of the first elastic member 140 is parallel to the extending direction of the swing rod 130; the first end of the first elastic member 141 is fixed on the connecting part 132, and the second end of the first elastic member 142 is fixed on the inner wall of the movable seat 120. Arranging the extending direction of the first elastic member 140 parallel to the extending direction of the swing rod 130 can ensure a compact internal structural layout of the movable seat 120 and allow the movable seat 120 to be designed to be smaller in size. On this basis, in order to ensure the normal driving of the swing rod 130 by the first elastic member 140, the connecting part 132 is provided at an angle on the first end of the swing rod 1301. The connecting part 132 receives the elastic force to ensure that when the elastic force direction provided by the first elastic member 140 is substantially the same as the extending direction of the swing rod 130, the swing rod 130 can still be driven to rotate and swing out. Finally, in order to prevent the connecting part 132 from invading too much space inside the movable seat 120 when the swing rod 130 rotates and swings out, the rotating shaft 131 is provided on the side wall of the first end of the swing rod 1301.

Figure 8:
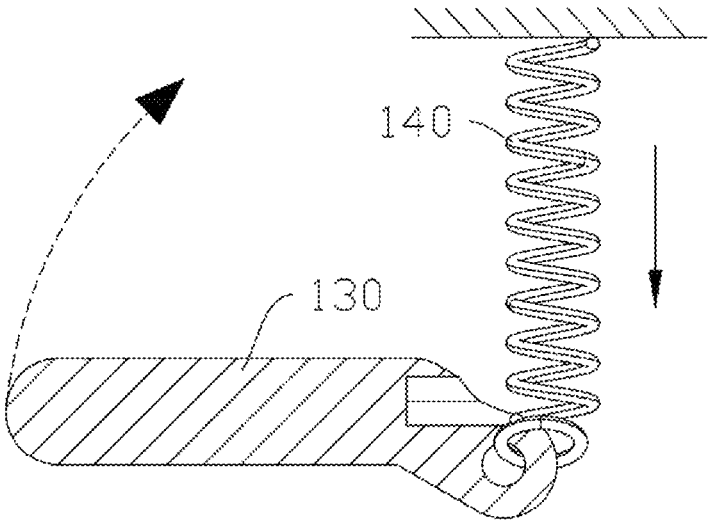
FIG. 8 is a schematic structural diagram of another modification of the first elastic member and the swing rod in the toy.

In order to ensure the stability of the connection between the swing rod and the movable seat and the reliability of the working mechanism of the internal movable seat. The present disclosure further proposes another embodiment, please refer to FIG. 8, the figure shows the exploded structure of the swing rod and the movable seat. A strip groove 122 is provided on the outer wall of the movable seat 120, one end inside the strip groove 122 is provided with a connection port 1221 that communicates with the internal space of the movable seat 120; the swing rod 130 is rotatably connected to the inside of the strip groove 122; the connecting part 132 extends into the connecting port 1221 and is fixedly connected to the first elastic member 140 inside the movable seat 120; the notch of the strip groove 122 forms the window 121.

The strip groove 122 is provided on the outer wall of the movable seat 120 to accommodate the swing rod 130, so that the space where the swing rod 130 is located and the space where the first elastic member 140 is located are separated by the groove wall of the strip groove 122. This ensures that problems such as structural interference are less likely to occur when the swing rod 130 swings out, the response is faster, and the first elastic member 140 works more reliably. At the same time, in order to ensure that the first elastic member 140 can normally drive the swing rod 130 to rotate, the connection port 1221 is provided at one end inside the strip groove 122. The inclined connecting part 132 extends into the connecting port 1221 and is fixedly connected to the first elastic member 140 so that the elastic force of the first elastic member 140 can be applied to the swing rod 130 through the connecting part 132 to drive the swing rod 130 to rotate.

Referring to FIG. 2 and FIG. 3, the shell 110 comprises a shell head 113 and a shell tail 114, which are respectively located at both ends of the shell 110 along the sliding direction of the movable seat 120; the interior of the shell 110 is formed with an accommodating cavity 115; an opening 116 is provided at the shell tail 114, and the accommodation cavity 115 is connected to the opening 116; the first part 1201 is slidably disposed in the accommodation cavity 115, the opening 116 is used for the first part 1201 to slide out from the accommodation cavity 115 or retract into the accommodation cavity 115.

If the shape of the shell 110 is set to a character model such as Santa Claus, a robot, or a doll, the shell head 113 may be the head of the character model, and the shell tail 114 may be the feet of the character model or the base of the entire toy.

By arranging the first part 1201 to slide out from the accommodation cavity 115 or retract into the accommodation cavity 115 through the opening 116 of the shell tail 114, the bottom of the toy is in a retractable form, increasing the fun.

Figure 9:
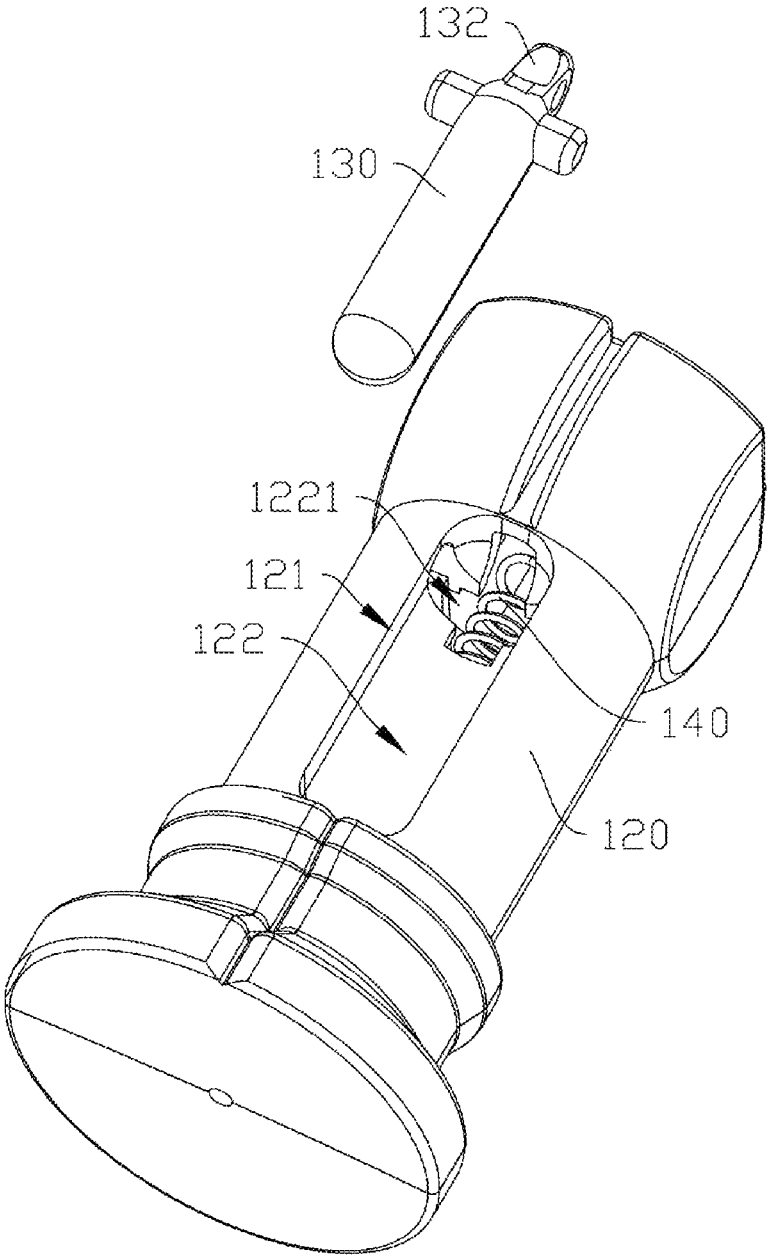
FIG. 9 is a schematic structural diagram of the toy shown in FIG. 1 after the swing rod and movable seat explode.

Furthermore, referring to FIG. 9, it shows the structure inside the shell. A second elastic member 150 is connected between one end of the movable seat 120 facing the shell head 113 and the inner wall of the shell head 113; the second elastic member 150 is configured to provide elastic force to the movable seat 120 to cause the first part 1201 to slide and retract into the shell 110.

Similarly, the second elastic member 150 can be a spring as shown in FIG. 9, or a spring piece, a rubber band, etc., which is not limited. In the specific embodiment shown in FIG. 9, the movable seat 120 is provided with a connecting ring 123 at one end toward the shell head 113, the inner wall of the shell head 113 is provided with a connecting column 117, and both ends of the second elastic member 150 are sleeved and fixed on the connecting ring 123 and the connecting column 117 respectively.

By connecting the second elastic member 150 between the movable seat 120 and the inner wall of the shell head 113, the user can release the movable seat 120 after pulling out the first part 1201 of the movable seat 120 from the shell 110. The first part 1201 can be retracted under the elastic force of the second elastic member 150 to realize the automatic reset of the movable seat 120.

In order to avoid the risk of falling off due to excessive sliding of the movable seat, the present disclosure further proposes the embodiment, please refer to FIG. 6. The outer wall of the movable seat 120 is provided with a first limiting part 124 and a second limiting part 125, the second limiting part 125 is located between the first limiting part 124 and the shell head 113; the first limiting part 124 is used to abut the outer wall of the opening 116 when the first part 1201 is retracted into the shell 110; the second limiting part 125 is used to abut the inner wall of the opening 116 when the first part 1201 extends out of the shell 110; the first limiting part 124 and the second limiting part 125 are jointly used to limit the sliding stroke of the movable seat 120.

In the specific embodiment shown in FIG. 6, the first limiting portion 124 is a raised surface formed on the side of the movable seat 120 near the bottom. The second limiting part 125 is a convex surface formed on the side of the movable seat 120 near the top position. In other embodiments, the first limiting portion 124 and the second limiting portion 125 can also be configured as bumps, annular protrusions, or the like.

When the first part 1201 is retracted into the shell 110, the first limiting part 124 abuts against the outer wall of the opening 116 as shown in FIG. 6, so that the movable seat 120 cannot continue to be retracted inward. Correspondingly, when the first part 1201 slides outward and extends to the maximum stroke, the second limiting part 125 will contact the inner wall of the opening 116 so that the first part 1201 cannot continue to extend outward.

Through the cooperation of the first limiting part 124 and the second limiting part 125 with the inner and outer walls of the opening 116, the sliding stroke of the movable seat 120 is controlled. It is ensured that the movable seat 120 will not slide too far outward and fall off, nor will it slide too much inward and be completely retracted into the shell 110.

Furthermore, referring to FIG. 6, the sliding direction of the movable seat 120 is the axial direction of the housing 110 and the movable seat 120 (the direction indicated by the double arrow a in the figure), the radial dimension $L_1$ of the accommodation cavity 115 (the radial direction is the direction indicated by the double arrow b in the figure) is larger than the radial dimension L2 of the opening 116. The movable seat 120 includes a movable seat head 126 and a movable seat tail 127, respectively located at both ends of the movable seat 120 along its sliding direction; a movable seat base 128 is connected between the movable seat head 126 and the movable seat tail 127; the movable seat head 126 and the movable seat base 128 form the first part 1201; the movable seat tail 127 forms the second part 1202. The radial dimensions $L_3$ of the movable seat head 126 adjacent to the movable seat base 128; the radial dimensions $L_4$ of the movable seat tail 127 adjacent to the movable seat base 128 are larger than the radial dimensions $L_5$ of the movable seat base 128 itself and are larger than the radial dimensions $L_2$ of the opening 116, so that the second limiting part 125 is formed on the movable seat head 126 adjacent to the movable seat base 128; the first limiting part 124 is formed on the movable seat tail 127 adjacent to the movable seat base 128.

The radial dimension of the accommodation cavity 115 is larger than the radial dimension of the opening 116, which makes the space inside the shell 110 for the movable seat 120 to be a closed-mouth cavity. The radial dimension of the movable seat head 126 and the movable seat tail 127 is set to be larger than the radial size of the movable seat base 128. Therefore, the second limiting part 125 that abuts the inner wall of the opening 116 is formed on the movable seat head 126 adjacent to the movable seat base 128. The first limiting part 124 that abuts the outer wall of the opening 116 is formed on the movable seat tail 127 adjacent to the movable seat base 128 to control the sliding stroke of the movable seat 120, and the sliding stroke is basically the size of the movable seat base 128 along the axial direction.

Figure 10:
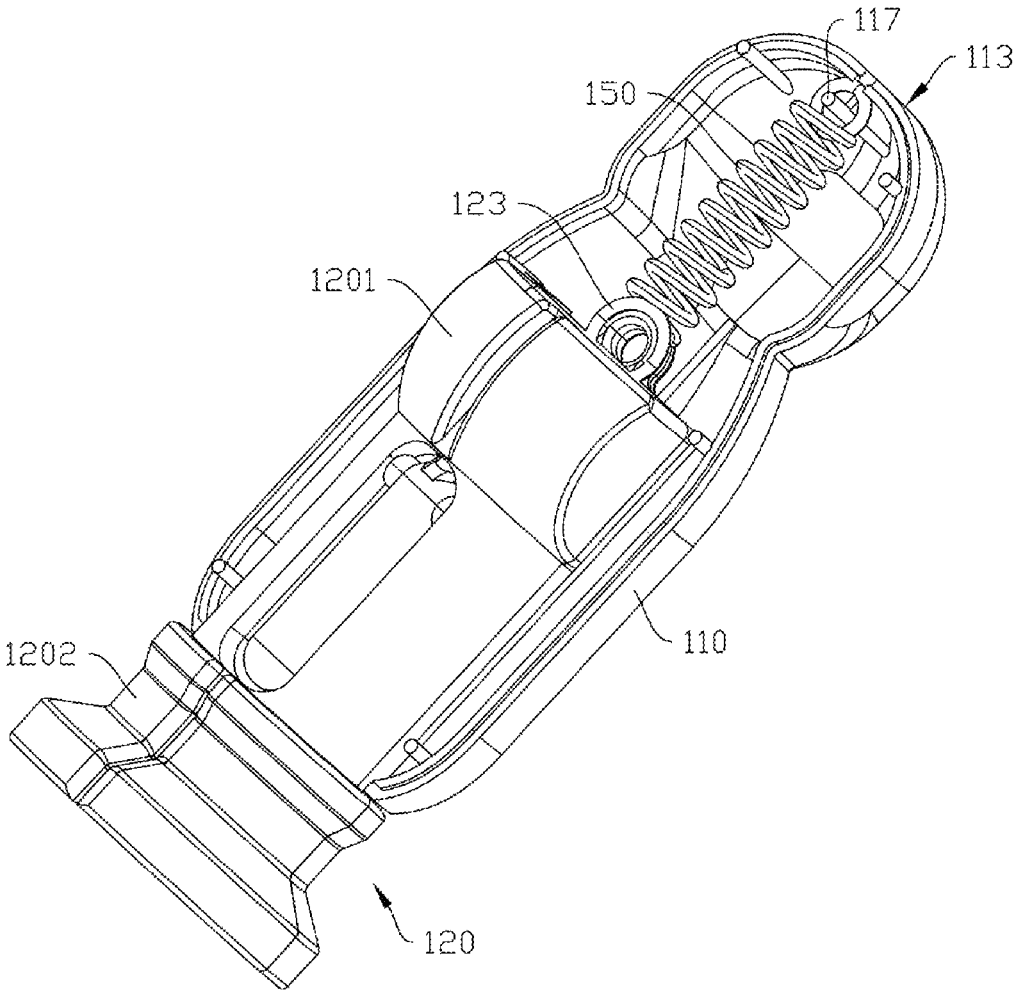
FIG. 10 is a schematic structural diagram of the inside of the shell of the toy shown in FIG. 1.

When the space in the shell for the sliding seat of the movable seat is set as a closed-mouth cavity, in order to prevent the swing rod from swinging out in the accommodation cavity, causing structural interference between the swing rod and the inner wall of the opening when the first part of the movable seat extends outward. The present disclosure further proposes another embodiment, please referring to FIG. 10 and FIG. 11. The Figures show the explosion structure from two different perspectives of the movable seat and part of the shell. The window 121 is arranged on the side wall of the movable seat base 128; the shell 110 is provided with an abutting portion 118 on an inner wall opposite to the window 121, the abutting portion 118 is used to contact the swing rod 130 when the movable seat base 128 is retracted into the shell, so as to press the swing rod 130 back into the window 121.

Figure 11:
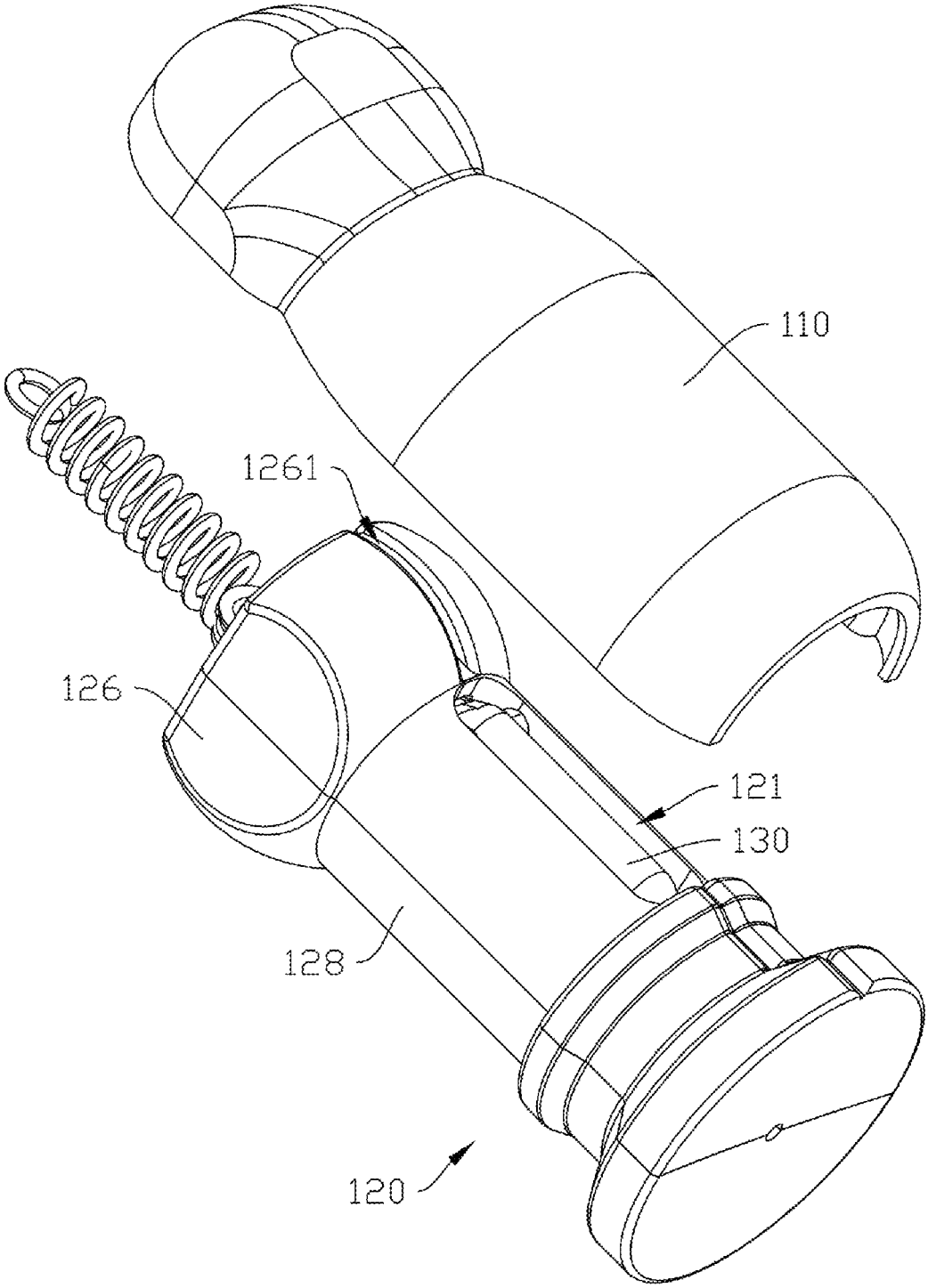
FIG. 11 is a schematic structural diagram of the toy shown in FIG. 1 after the movable seat and part of the shell exploded.
Figure 12:
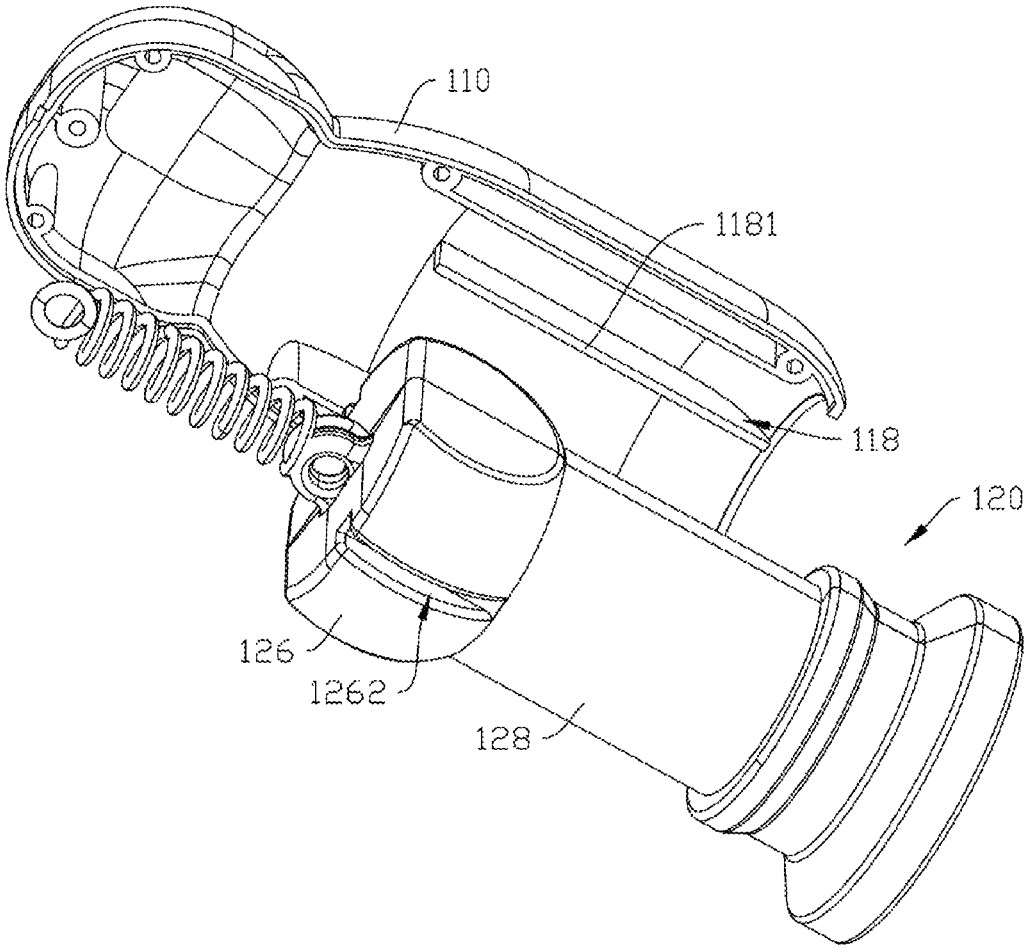
FIG. 12 is a schematic structural diagram of the toy shown in FIG. 1 after the movable seat and another part of the shell exploded.

For a more intuitive display, please continue to refer to FIG. 11 and further combine it with FIG. 12, which shows the cross-sectional structure along the B-B direction of FIG. 5. The abutting portion 118 may be a raised plate integrally formed with the shell 110, and the abutting portion 118 extends to the opening 116. When the movable seat base 128 is retracted into the shell 110, the outside of the swing rod 130 is squeezed by the abutment portion 118 and swings back into the window 121. And when the movable seat base 128 slides outward, the abutment portion 118 can always restrict the second end of the swing rod 1302 from swinging out inside the shell 110, thereby preventing the toy from being damaged due to structural interference between the swing rod 130 and the inner wall of the shell 110.

In order to ensure the accuracy of the sliding direction of the movable seat 120. The present disclosure further proposes another embodiment, please referring to FIG. 10 and FIG. 11. The abutting portion 118 is the first strip protrusion 1181 extending along the sliding direction of the movable seat 120; the outer wall of the movable seat head 126 is correspondingly provided with a first guide chute 1261; the first strip protrusion 1181 is in sliding fit with the first guide chute 1261.

By configuring the abutting portion 118 as the first strip protrusion 1181 extending along the sliding direction of the movable seat 120, the abutting portion 118 can not only restrict the swing of the swing rod 130 inside the shell 110. At the same time, after cooperating with the first guide chute 1261 on the movable seat head 126, it can also play a guiding role in the sliding of the movable seat 120, ensuring the accuracy and reliability of the sliding of the movable seat 120.

Figure 13:
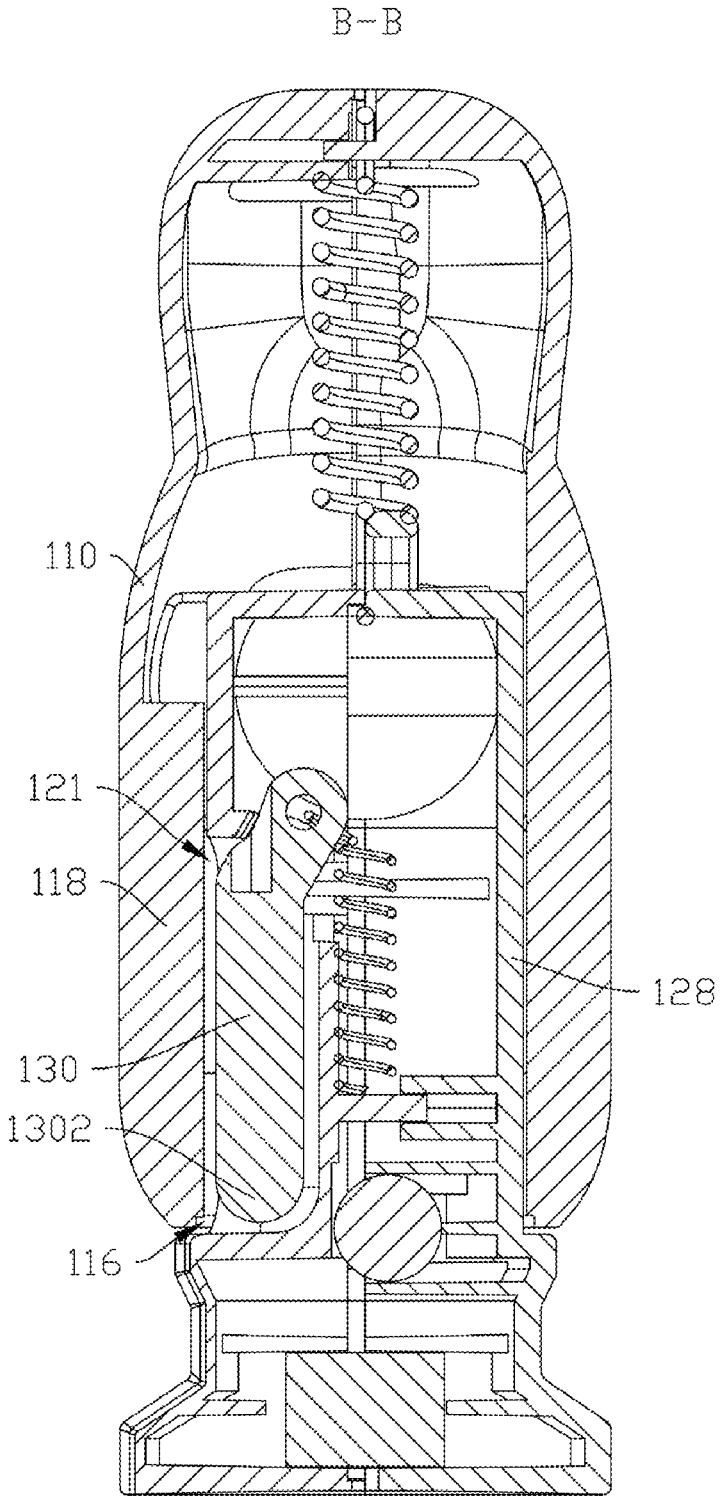
FIG. 13 is a schematic cross-sectional structural diagram along the B-B direction of FIG. 5.

In order to achieve more accurate control of the sliding direction of the movable seat, the present disclosure further proposes another embodiment, please referring to FIG. 11 and further combine with FIG. 13. FIG. 13 shows the exploded structure of the movable seat and another part of the shell. The inner wall of the shell 110 opposite to the first strip protrusion 1181 is provided with a second strip protrusion 1182, a second guide chute 1262 is provided on the outer wall of the movable seat head 126 opposite to the first guide chute 1261; the second strip protrusion 1182 is in sliding fit with the second guide chute 1262.

On the basis of the first strip protrusion 1181 slidingly fitting with the first guide chute 1261 for guidance, by setting the second strip protrusion 1182 and the second guide chute 1262 with sliding fit at positions opposite to them, it can ensure a stable and reliable guiding function for the sliding movement of the movable seat 120.

Please refer to FIG. 13 again, in some embodiments, the two sides of the movable seat head 126 are first guide planes 1263 parallel to each other; a second guide plane 119 is disposed oppositely on the inner wall of the shell 110; the first guide plane 1263 is in sliding fit with the second guide plane 119.

Specifically, both the first guide plane 1263 and the second guide plane 119 can be set as smooth planes, and they can directly slide relative to each other through friction fit. Through the sliding fit between the first guide plane 1263 and the second guide plane 119, a good guiding effect is achieved when the movable seat 120 slides relative to the shell 110.

Figure 14:
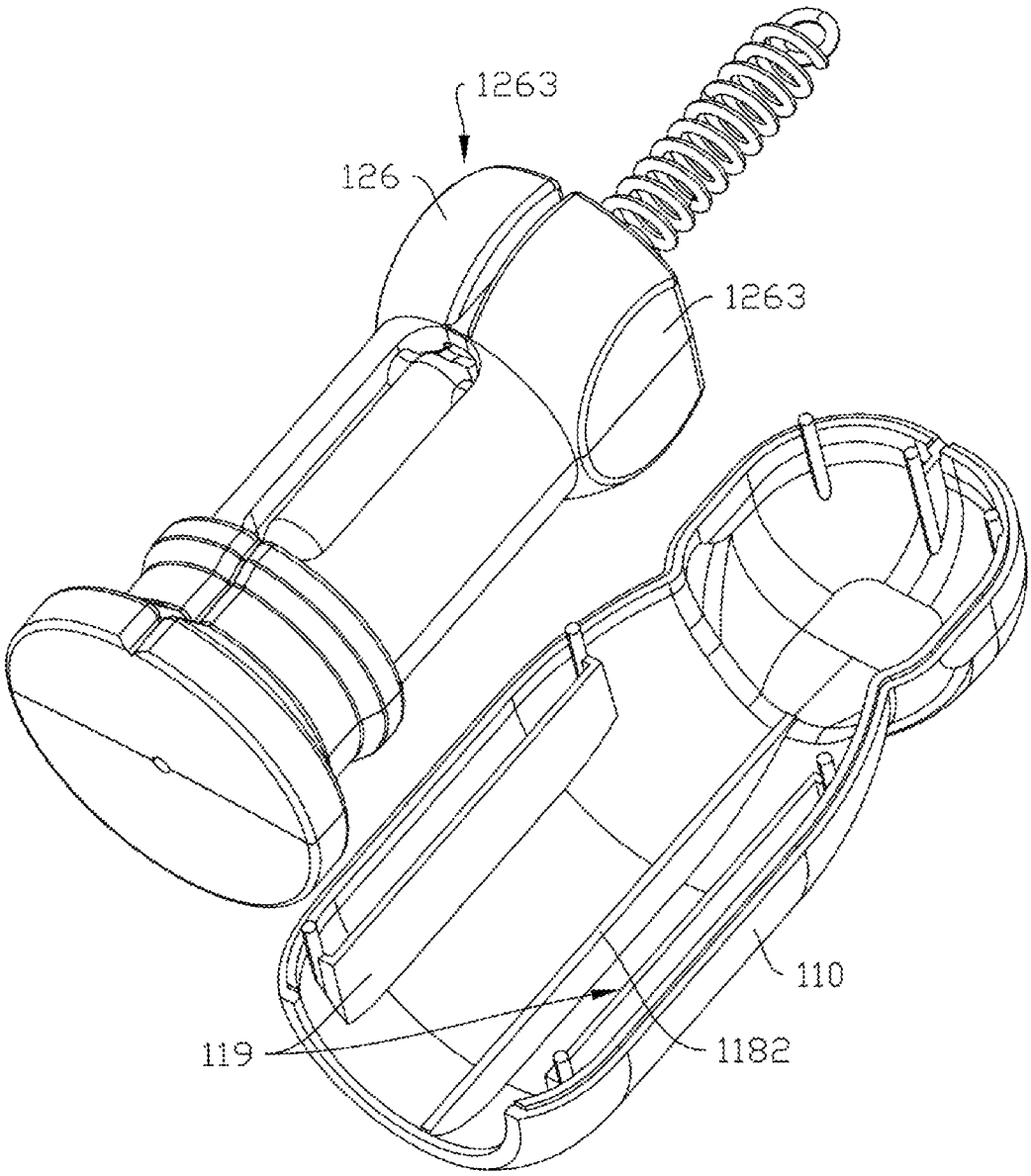
FIG. 14 is a schematic diagram of the structure shown in FIG. 11 from another perspective.
Figure 15:
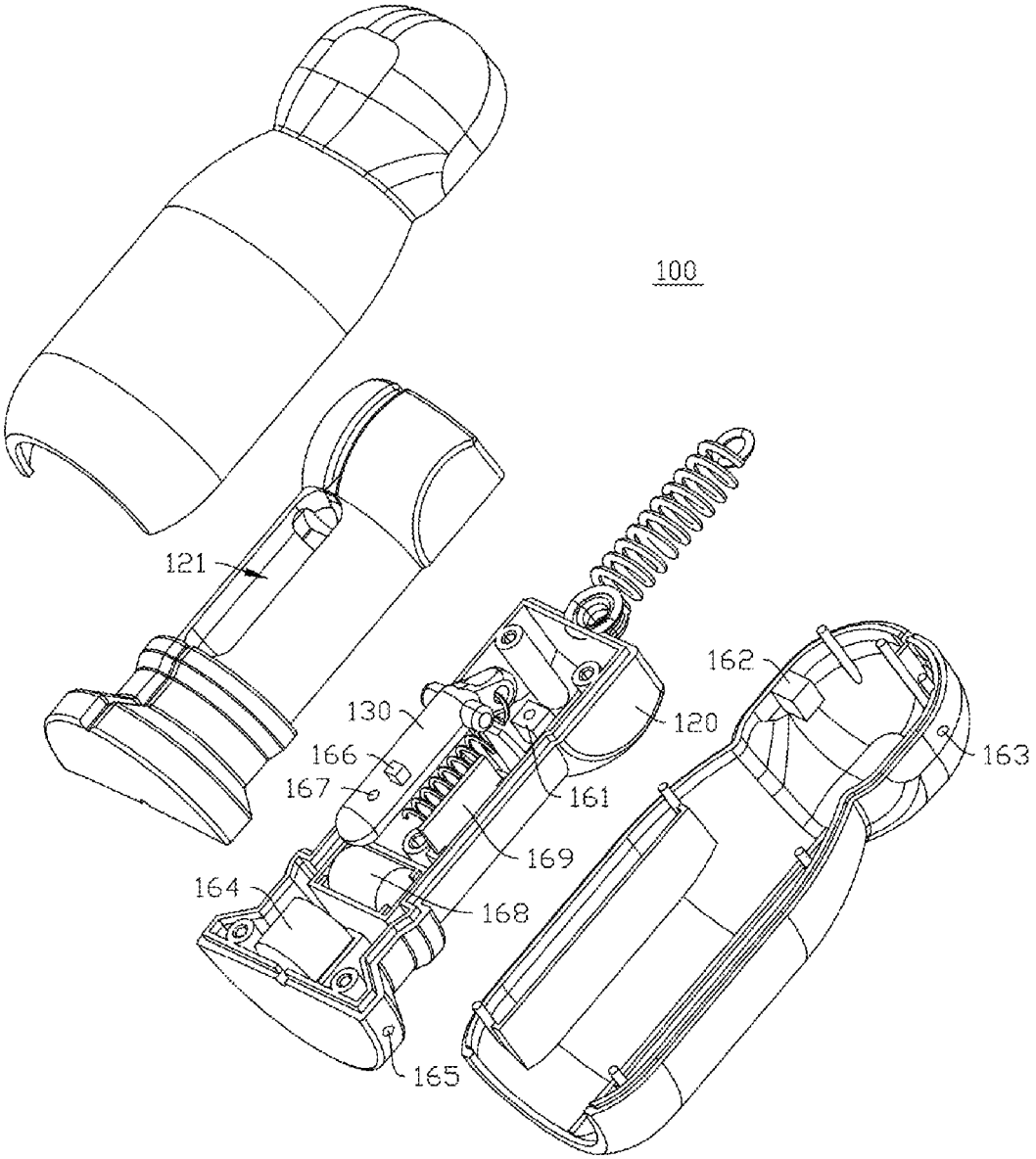
FIG. 15 is a schematic diagram of the explosive structure of the toy.

In order to further increase the fun of toys, the present disclosure further proposes another embodiment, please referring to FIG. 14. The figure shows the entire exploded structure of the toy. A switch 161 is provided inside the movable seat 120; the switch 161 is configured to be triggered when the swing rod 130 out of the window 121; a first buzzer 162 is provided inside the shell 110, the first buzzer 162 is configured to emit a sound when the switch 161 is triggered; a first lamp body 163 is provided on the shell 110, and the first lamp body 163 is configured to emit light when the switch 110 is triggered; a second buzzer 164 is provided inside the movable seat 120, and the second buzzer 164 is configured to emit a sound when the switch 161 is triggered; a second lamp body 165 is provided on the movable seat 120, and the second lamp body 165 is configured to emit light when the switch 161 is triggered; a third buzzer 166 is provided inside the swing rod 130, and the third buzzer 166 is configured to emit a sound when the switch 161 is triggered; a third lamp body 167 is provided on the swing rod 130, and the third lamp body 167 is configured to emit light when the switch 161 is triggered. The first buzzer 162, the second buzzer 164 and the third buzzer 166 are all configured to emit a sound when the switch 161 is triggered. And the first lamp body 163, the second lamp body 165 and the third lamp body 167 are all configured to emit light when the switch 161 is triggered.

FIG. 14 is only an exemplary illustration provided by the embodiment of the present disclosure. It can be understood that in some embodiments, the toy 100 can also be provided with only one or more of the first buzzer 162, the second buzzer 164, the third buzzer 166, the first lamp body 163, the second lamp body 165 and the third lamp body 167, which can be set accordingly according to needs.

It should also be noted that the switch 161 can be a contact switch. When the swing rod 130 swings out from the window 121, one end inside the swing rod 130 presses the contact of the switch, so that the switch 161 is triggered. In addition, the switch 161 can also be an infrared induction switch. When the swing rod 130 swings out from the window 121, one end of the swing rod 130 blocks the infrared rays, causing the switch 161 to be triggered.

As shown in FIG. 14, a battery 168 and a control circuit board 169 can be installed in the movable seat 120. The battery 168 is electrically connected to the control circuit board 169, and the control circuit board 169 is electrically connected to the switch 161, buzzer and lamp body. When the switch 161 is triggered, it sends a corresponding signal to the control circuit board 169, and the control circuit board 169 supplies power to the buzzer and the lamp body through the battery 168, so that the buzzer and the lamp body work.

Above are only preferred embodiments of the present disclosure and are not intended to limit the present disclosure. Any modification, equivalent replacement and improvement made within spirit and principle of the present disclosure should be included in protective scope of the present disclosure.

What is claimed is:

1. A toy, comprising:

a shell, a movable seat and a swing rod; wherein the shell is configured to be secured by one hand and the movable seat is configured to be manually pulled out of the shell by another hand;

wherein the movable seat comprises a first portion and a second portion connected to the first portion, wherein the first portion is slidably disposed inside the shell, wherein the second portion protrudes from the shell, wherein a side wall of the first portion defines a window;

wherein the window is configured to be exposed from the shell as the first portion slides out of the shell, and is configured to be hidden inside the shell as the first portion slides back into the shell;

wherein the swing rod is rotatably disposed inside the movable seat and is configured to rotate when the window is exposed and at least part of the swing rod swings out from the window, wherein when the window is hidden in the shell as the first portion slides back into the shell, the swing rod is entirely retracted into the window;

wherein the toy further comprises a first elastic member that is connected between a first end of the swing rod and an inner wall of the movable seat; wherein the first elastic member is configured to provide an elastic force to the swing rod to cause the swing rod to swing out from the window when the swing rod is retracted into the window, so that when the window is exposed from the shell, the swing rod is driven to swing out from the window; wherein a side wall of the first end of the swing rod is provided with a rotating shaft, which is rotationally connected to the inner wall of the movable seat; wherein an end of the first end of the swing rod extends obliquely to form a connecting part; wherein the first elastic member is strip-shaped, and wherein an extending direction of the first elastic member is parallel to an extending direction of the swing rod when the swing rod is retracted back into the window; wherein the first end of the first elastic member is fixed to the connecting part, and wherein a second end of the first elastic member is fixed to the inner wall of the movable seat;

wherein the shell comprises a shell head and a shell tail, which are respectively located at both ends of the shell along a sliding direction of the movable seat; wherein a second elastic member is connected between one end of the movable seat facing the shell head and an inner wall of the shell head; wherein the second elastic member is configured to provide an elastic force to the movable seat to cause the first portion to slide and retract back into the shell.

2. The toy of claim 1, wherein there is defined a strip-shaped groove in an outer wall of the movable seat, wherein one end inside the strip groove defines a connection port that is in communication with an internal space of the movable seat; wherein the swing rod is rotatably connected to an inside of the strip groove; wherein the connecting part extends into the connecting port and is fixedly connected to the first elastic member inside the movable seat; wherein an opening of the strip groove forms the window.

3. The toy of claim 1, wherein an interior of the shell defines an accommodating cavity; wherein there is defined an opening at the shell tail, and wherein the accommodation cavity is in communication with the opening; wherein the first portion is slidably disposed in the accommodation cavity, the opening is used for the first portion to slide out from the accommodation cavity or retract into the accommodation cavity.

4. The toy of claim 3, wherein an outer wall of the movable seat is provided with a first limiting part and a second limiting part, the second limiting part is located between the first limiting part and the shell head;

the first limiting part is used to abut an outer wall of the opening when the first portion is retracted into the shell; the second limiting part is used to abut an inner wall of the opening when the first portion extends out of the shell; the first limiting part and the second limiting part are jointly used to limit the sliding stroke of the movable seat.

5. The toy of claim 4, wherein a sliding direction of the movable seat is an axial direction of the shell and the movable seat; wherein a radial dimension of the accommodation cavity is larger than a radial dimension of the opening;

wherein the movable seat comprises a movable seat head and a movable seat tail, respectively located at both ends of the movable seat along its sliding direction; wherein a movable seat base is connected between the movable seat head and the movable seat tail; wherein the movable seat head and the movable seat base form the first portion; the movable seat tail forms the second portion;

wherein a radial dimension of the movable seat head adjacent to the movable seat base, and a radial dimension of the movable seat tail adjacent to the movable seat base are each greater than the radial dimension of the movable seat base itself and are each greater than a radial dimension of the opening, so that the second limiting part is formed on the movable seat head adjacent to the movable seat base, and the first limiting part is formed on the movable seat tail adjacent to the movable seat base.

6. The toy of claim 5, wherein two sides of the movable seat head are two first guide planes parallel to each other; a second guide plane is disposed oppositely on the inner wall of the shell; wherein the first guide plane is in a sliding fit with the second guide plane.

7. The toy of claim 5, wherein the window is defined in a side wall of the movable seat base; wherein the shell comprises an abutting portion on an inner wall of the shell opposite to the window, wherein the abutting portion is configured to abut against the swing rod when the movable seat base is retracted into the shell, so as to press the swing rod back into the window.

8. The toy of claim 7, wherein the abutting portion is a plate that runs substantially perpendicular to the inner wall of the shell.

9. The toy of claim 7, wherein the abutting portion comprises a first strip-shaped protrusion extending along the sliding direction of the movable seat; wherein the outer wall of the movable seat head is correspondingly provided with a first guide chute; wherein the first strip protrusion is in sliding fit with the first guide chute.

10. The toy of claim 9, wherein the inner wall of the shell opposite to the first strip protrusion comprises a second strip protrusion, wherein a second guide chute is defined in the outer wall of the movable seat head opposite to the first guide chute; wherein the second strip protrusion is in a sliding fit with the second guide chute.

11. The toy of claim 1, wherein a switch is disposed inside the movable seat; the switch is configured to be triggered when the swing rod out of the window; wherein the toy further comprises at least one selected from a group consisting of the following:

a first buzzer, disposed inside the shell and configured to emit a sound when the switch is triggered;

a first lamp body, disposed on the shell and configured to emit light when the switch is triggered;

a second buzzer, is disposed inside the movable seat and configured to emit a sound when the switch is triggered;

a second lamp body, disposed on the movable seat and configured to emit light when the switch is triggered;

a third buzzer, disposed inside the swing rod and configured to emit a sound when the switch is triggered; and a third lamp body, disposed on the swing rod and configured to emit light when the switch is triggered.

* * * * *